United States Patent [19]

Rousey

[11] 3,965,632

[45] June 29, 1976

[54] FIRE RATED GRID

[75] Inventor: Donald L. Rousey, Des Plaines, Ill.

[73] Assignee: Questor Corporation, Toledo, Ohio

[22] Filed: July 23, 1975

[21] Appl. No.: 598,207

Related U.S. Application Data

[63] Continuation-in-part of Ser. No. 490,065, July 19, 1974, abandoned.

[52] U.S. Cl. ..... 52/232; 52/495; 52/573; 52/DIG. 5

[51] Int. Cl.[2] ..... E04C 2/42; E04B 1/98

[58] Field of Search ..... 52/232, DIG. 5, 573, 52/484, 495, 667, 729

[56] References Cited

UNITED STATES PATENTS

| | | | |
|---|---|---|---|
| 3,169,614 | 2/1965 | McCoy | 52/484 |
| 3,333,378 | 8/1967 | Jahn et al. | 52/729 |
| 3,378,976 | 4/1968 | Meredith | 52/573 |
| 3,388,519 | 6/1968 | Downing | 52/573 |
| 3,397,501 | 8/1968 | Jahn | 52/573 |
| 3,589,089 | 10/1969 | Kedel | 52/DIG. 5 |
| 3,778,947 | 12/1973 | Sauer | 52/232 |
| 3,846,031 | 11/1974 | Adams | 52/DIG. 5 |

FOREIGN PATENTS OR APPLICATIONS

| | | | |
|---|---|---|---|
| 829,299 | 3/1960 | United Kingdom | 52/729 |

*Primary Examiner*—Ernest R. Purser
*Assistant Examiner*—James L. Ridgill, Jr.
*Attorney, Agent, or Firm*—Olson, Trexler, Wolters, Bushnell & Fosse, Ltd.

[57] ABSTRACT

A girder-like runner for use with fire-rated suspended ceiling structure is disclosed. The runner is provided with a bottom flange, an interrupted top bead, and a web including a diamond-shaped expansion member. A lower web portion adjacent the flange is formed with two opposed lipped ledges. Buckling forces caused by first-induced thermal expansion force the web expansion member to deform outwardly into a foreshortened diamond shape. The forces also cause the ledge web portion and the flange downwardly in a controlled, predetermined manner which retains runner strength.

18 Claims, 9 Drawing Figures

FIRE RATED GRID

BACKGROUND OF THE INVENTION

This application is a continuation-in-part of my copending application Ser. No. 490,065, filed July 19, 1974 now abandoned.

The present invention relates generally to ceiling constructions, and more particularly concerns a girder-like runner which can be used to support acoustical tiles and other ceiling structure.

In recent years, it has been common in the construction of new buildings and in the renovation of old buildings to employ suspended ceilings. Broadly speaking, these ceilings include a grid system formed of girder-like runners suspended from primary ceiling members, building beams or other support points. The runners in turn support acoustical tiles, lights or other ceiling structure.

In most such ceiling systems, the flanged runners are arranged in a rectangular grid system. Relatively long parallel runners may be formed of interjoined sections, and are often called main runners. These main runners are joined at suitable spaced apart intervals by transverse parallel beams commonly called cross-tees.

Such ceilings have proved attractive, economical and effective. However, when the runners of such a ceiling system are subjected to the high temperatures accompanying a fire, the runners tend to twist and buckle in an uncontrolled manner due to the stresses imposed by thermal expansion or other causes. This buckling results from the restraint imposed on thermally caused longitudinal runner expansion of the individual runners by the grid construction and by the connection of the runners with relatively stationery walls or other parts of the building. Runner twisting and buckling often causes the ceiling panels and other ceiling structure to be broken, to separate from the runners, and to drop on the room and floor beneath.

Thus, even though ceiling panels and other ceiling structure highly resistant to fire conditions have been developed, much of the fire retarding advantage of the ceiling system is lost if the runners or cross-tees buckle and the panels fall away. However, if such ceiling structure can be maintained in its position in the ceiling for as much as a few minutes longer than otherwise possible, the ceiling and the air space between the building structural ceiling and the lower suspended ceiling provide insulation to protect the building superstructure. Thus, the structural integrity of the suspended ceiling may not only prevent damage from falling tiles or beams to the contents of the room below, but may prevent the structural ceiling of the building and the building itself from collapsing.

Ceiling runners have been previously offered which attempt to accommodate the thermally induced longitudinal expansion forces resulting from the high temperatures of fires. Among these runner designs are those disclosed in U.S. Pat. No. 3,496,690 and others. However, many of these structures provide somewhat lessened or weakened support for the ceiling structure during normal use, many are expensive, and some require complex installation tools and procedures.

Many of these beams, while accommodating fire-caused or other longitudinal stresses to some extent, nevertheless may buckle in an uncontrolled manner, thereby causing the integrity of the suspended ceiling to be lost.

It is therefore the general object of the present invention to provide a runner for a ceiling construction and the like which is strong, relatively easy to manufacture, and which buckles or deforms in a controlled manner when excessive longitudinal forces are applied to it, as by fire-caused thermal expansion.

It is another object of the invention to provide a runner for a ceiling construction which will resist fire temperatures for a relatively long time without deforming in an uncontrolled manner. It is a related object to provide such a runner which will resist fire temperatures without dropping its load of ceiling panels, lights, cross-tee runners and other structure.

It is yet another object of the invention to provide a runner for a ceiling construction or the like which will accommodate the hot temperatures of a fire without dropping its load, yet which can be installed without introducing additional installation complexities and costs. A related object is to provide such a runner which does not require special tools, methods or material for its installation. A further related object is to provide such a runner which is relatively easy to manufacture and install.

Other objects and advantages of the invention will become apparent upon reading the following detailed description and upon reference to the drawings. Throughout the description, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Figures 1, 2, 3, 4, 5, 6:
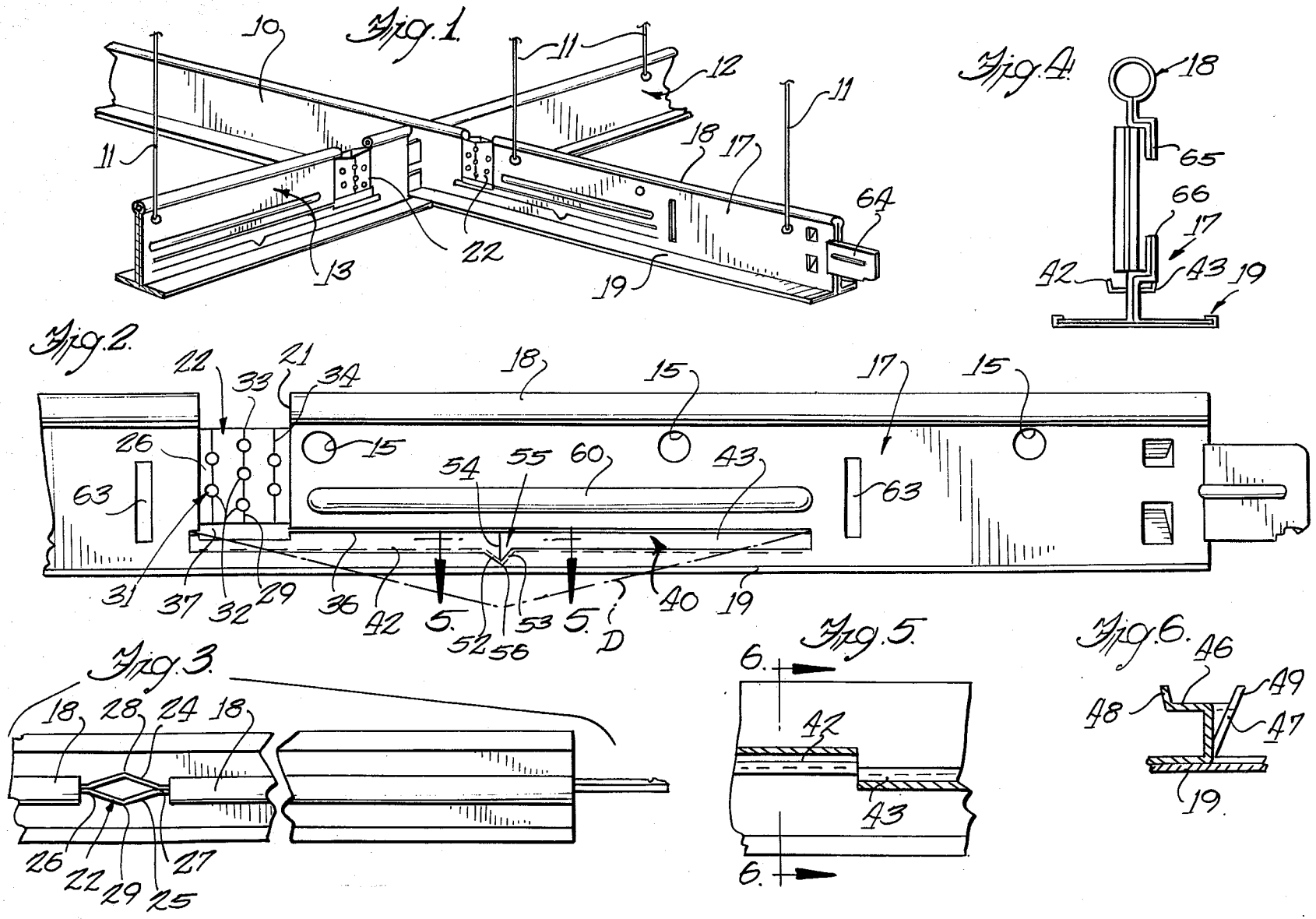
FIG. 1 is a perspective view showing the novel runner member as it appears when installed in a building and suspended from a structural ceiling.
FIG. 2 is a side elevational view showing in further detail the novel runner construction.
FIG. 3 is a top plan view of the runner shown in FIG. 2.
FIG. 4 is an end elevational view of the runner shown in FIGS. 2 and 3.
FIG. 5 is a sectional view taken substantially in the plane of line 5—5 in FIG. 2.
FIG. 6 is a sectional view taken substantially in the plane of line 6—6 in FIG. 5.

Turning first to FIG. 1, several novel runners embodying the present invention are shown. Particularly, a longitudinally extending main runner 10 is suspended, as by cables 11, from a structural ceiling (not shown). Transversely oriented cross-tee members 12 and 13 are also suspended as by cables 11 and are connected to the main longitudinal runner 10 in load bearing relationship, as is explained in further detail hereinafter. These cables 11 can be conveniently attached to the runners 10, 12 and 13 by passing the cables through attachment holes 15 or by other convenient means. Acoustical tiles, lights and other ceiling structure can be attached to the runners 10, 12 and 13 in conventional manner to form the completed ceiling.

It is contemplated that a grid-like array of these longitudinal runners 10 and cross-tee runners 12 and 13 will be formed within a building, and the terminal ends of the grid systems will be connected to, or will simply abut outer building walls or other building structure. When these runners 10, 12 and 13 are heated, they undergo thermal expansion and consequent longitudinal elongation. This longitudinal elongation will cause the runners to be longitudinally compressed by the building structure, and longitudinally oriented compressive forces are thus set up within one or more of the runners 10, 12 and 13. As explained above, these longitudinally oriented compressive forces can be accommodated within the beam by permitting the beam to buckle; and loss, droppage or damage to supported false ceiling parts can be avoided by permitting the heated beam to buckle in a controlled, predetermined manner.

The illustrated novel runners can be considered to comprise generally, a vertical oriented, longitudinally extended web 17, an enlarged but interrupted stiffener bead 18 extending along one margin of the web 17, and a stiffener flange 19 extending along the other web margin and oriented generally perpendicularly to the plane of the web 17. In accordance with the invention, the bead 18 is periodically interrupted by gaps 21, and the web 17 is provided with expansion members 22 which are substantially coextensive with the bead interruption 21 and which are adapted to accommodate runner expansion by buckling in a controlled manner. To this end, these expansion members each include at least two perforated reaches 24 and 25 which abut at opposite ends 26 and 27, but which diverge to spaced apart mid-portions 28 and 29 extending away from opposite sides of the web 17 as illustrated particularly in FIG. 3.

These reaches 24 and 25 are adapted to bend or buckle away from one another in a controlled manner into a longitudinally foreshortened diamond-shaped pattern extending away from both sides of the web 17 when compressive forces are applied to the runner in a longitudinal direction. In this shape, runner strength and rigidity can be maintained to a relatively high degree. In accordance with this aspect of the invention, this controlled bending or buckling is encouraged by providing three columns of perforations extending through both reaches 24 and 25. As illustrated in FIG. 2, a first column 31 of perforations 32 is located adjacent one end 26 of the expansion member 22. A second column 33 of perforations 32 is located at the mid-portion 28 and 29 of each expansion member reach 23 and 24, and a third column 34 of perforations 32 is located at the opposite end 27 of the expansion member 22. These perforation columns encourage reach and web bending along the perforation column orientations without excessively weakening the runner.

In further accordance with the invention, the runner 10 is designed to accommodate deformation of the flange 19 and a lower part of the web 17 in a controlled manner. To this end, a longitudinally oriented slot 36 extends through the web 17 and in substantially only one direction away from the expansion member 22. To accommodate minor variations in deformation of the expansion member 22 without engaging other parts of the beam and thereby imposing secondary stresses, the end 37 of the slot 36 underlying the expansion member 22 is enlarged.

To permit the flange 19 and adjacent portions of the web 17 to buckle or deform in a controlled manner in further accordance with the invention, that portion 40 of the web 17 located between the slot 36 and the flange 19 is formed to define two opposed but offset lipped ledges 42 and 43, as best envisioned from FIGS. 2 and 4–6. Each of these ledges includes a main ledge portion 46 and 47 extending away from the main plane of the web 17 in a direction substantially parallel to the runner flange 19 and away from one another. To provide further stiffening effect to this portion of the runner, the ledges terminate in upturned respective lip portions 48 and 49, which extend substantially parallel to the plane of the web member 17. This configuration provides stiffness and resistance to torsional buckling for each ledge 42 and 43, while permitting controlled runner deformation. Maintenance of the flange 19 directly below the web 17 is also encouraged, which inhibits uncontrolled buckling, or roll-over during fire-induced heating.

As illustrated particularly in FIG. 2, each ledge 42 and 43 terminates adjacent the opposite ledge 43 or 42 in respective downturned end portions 52 and 53 adjacent a ledge end defining slit 54. These end portions 52 and 53 together define a V-shaped configuration 55 having its apex 56 adjacent the runner flange 19. This structure permits the web flange 19 and the ledges 42 and 43 to buckle away from the remaining portion of the web 17 as generally illustrated by the dotted line D shown in FIG. 2 in a controlled manner in a predetermined configuration when compressive forces are applied to the runner in a longitudinal direction. Location of this V apex at a point spaced apart as a longitudinal distance from the expansion member 22 spreads the deformation results along the length of the beam, and thus encourages retention of overall runner shape and strength.

In further accordance with the invention, the remaining portions of the web 17 are stiffened against undesired deformation. To this end, a web stiffener bead 60 extends longitudinally along the web generally parallel to and coextensive with the web slot 36.

Connection of any runner 10 to adjacent runners 12 or 13 in load bearing relationship is relatively easy, and does not introduce additional complexities into beam installation and use. To this end, generally vertically elongated apertures 63 can be formed in the runner web 17 and are shaped to accommodate end hooks or other interconnecting structure. Similarly, each runner 10 terminates in a hook member 64 designed to engage these apertures 63. Alternatively, the hook member can be engagingly inserted into offset hook brackets 65 and 66 such as those shown in FIG. 4 to connect the runner 10 to adjacent, longitudinally coextensive runners.

Figure 7:
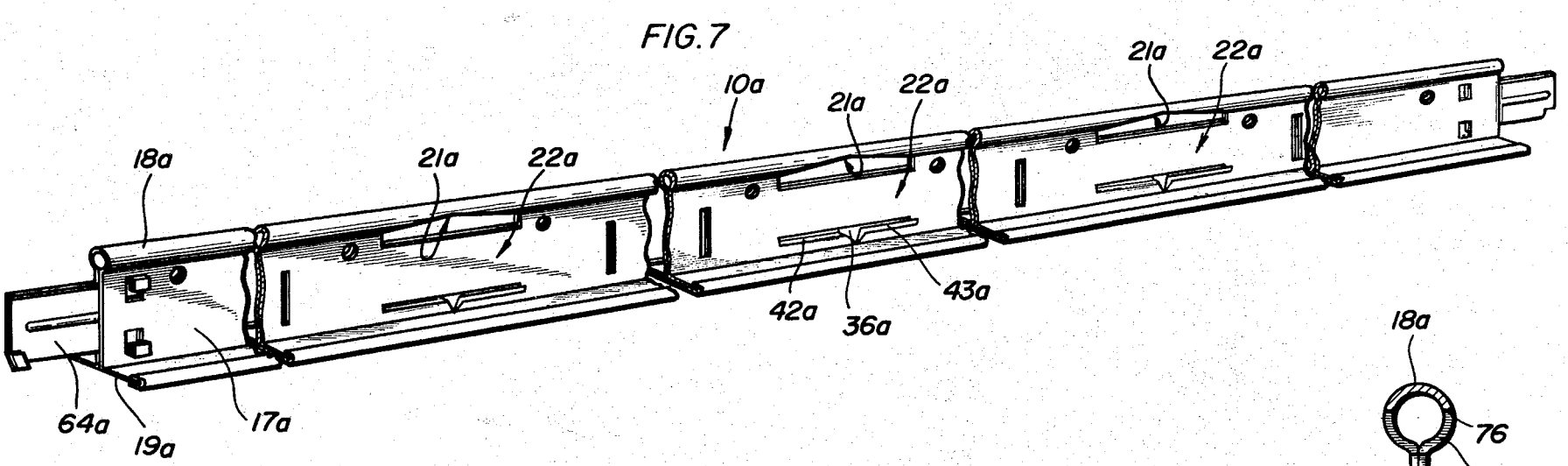
FIG. 7 is a perspective view showing a novel runner member embodying a modified form of the present invention.
Figure 9:
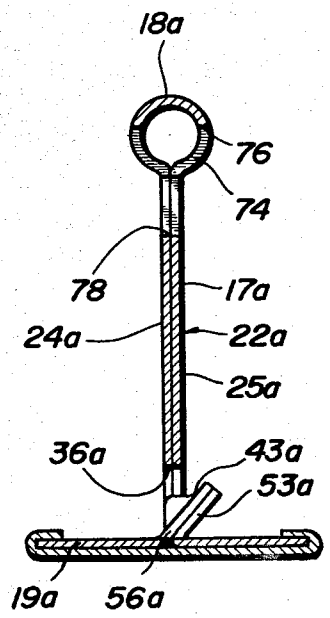
FIG. 9 is a cross-sectional view taken along line 9—9 in FIG. 8.
Figure 8:
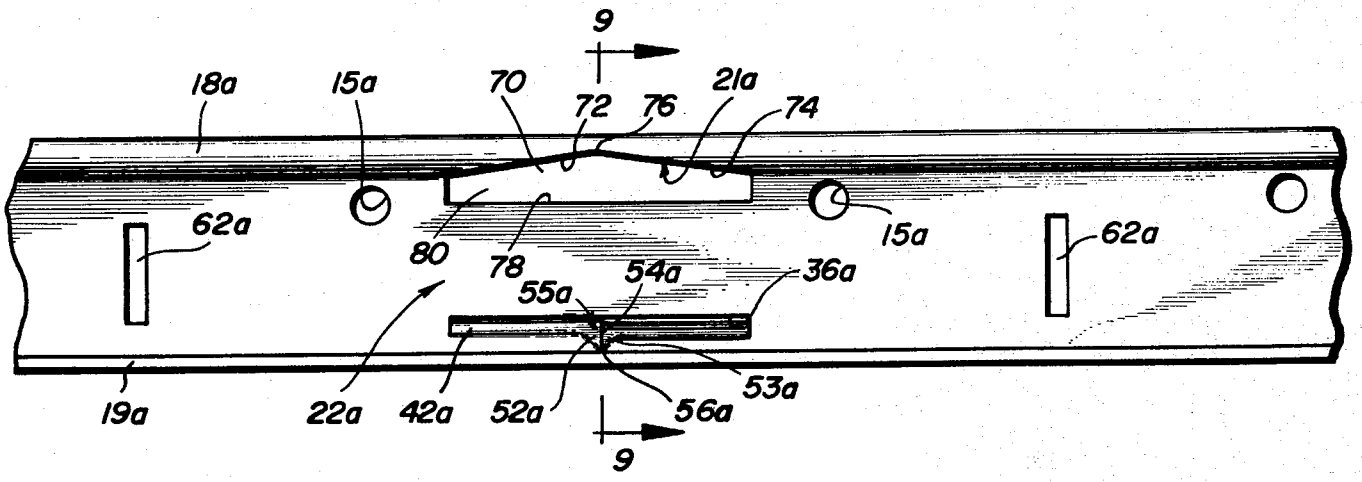
FIG. 8 is an enlarged fragmentary side elevational view of the novel runner member of FIG. 7.

Referring now to FIGS. 7, 8 and 9, runner 10a is shown which incorporates a modified form of the present invention. In this embodiment, elements which correspond to those described above are designated by the same reference numerals with the suffix *a* added. It will be noted that the slit 36*a* and related ledge elements 42*a* and 43*a* are identical to those previously described except for being somewhat shorter in relation to the longitudinal length of the runner. Furthermore, as shown in FIG. 7, the runner is provided with a plurality of the slits and related offset ledge elements at spaced intervals therealong. For example, in a 12 foot runner, three of the slits and complementary offset ledge elements are provided. This arrangement provides for a plurality of points along the runner where expansion may be accommodated for obtaining more uniform relief of the stresses throughout the grid system. While the spacing of the slit means and related ledge elements may be varied, preferably one of the slit means is located approximately midway between the opposite ends of the runner and other of the slit means are located adjacent opposite ends of the runner and, in the case of a 12 foot runner, approximately 2 feet from the runner ends.

The runner 10a further differs from the previously described structure in the formation of the interruptions or gaps 21*a* and expansion members 22*a* of the web 17 which are associated with each of the slit means 36*a*. More specifically, each interruption 21*a* is formed by cutting a slot or notch 70 partially through the bead 18*a* in a position in vertical alignment with an associated slit means 36*a*. Preferably the slot 70 is substantially longitudinally coextensive with an associated slit means 36*a* as shown best in FIG. 8. Furthermore, the slot 70 is formed so that the interruption 21*a* is defined by inverted V-shaped edges 72 and 74 intersecting each other at an apex 76 preferably in vertical alignment with the apex 56*a* between the V-shaped portions 52*a* and 53*a* of the ledge elements 42*a* and 43*a*. Thus a portion of the bead 18*a* which is relieved by the interruption 21*a* is adapted to buckle upwardly starting at the apex 76 in response to heat induced compression loads.

The expansion members 22*a* of the web 17 are defined along their lower margins by the slots or slit means 36*a* and along upper margins by edges 78 parallel to the slot means 36*a*. The edges 78 are provided by striking or otherwise forming slots 80 in the web 17*a*, which slots 80 merge with the slots 70 so that the resulting openings through the runner are defined at their lower margins by the edges 78 and along their upper margins by the previously mentioned edges 72 and 74. Thus, the resulting expansion portions 22*a* of the runner include strap elements or reaches 24*a* and 25*a* of the web defined by parallel upper and lower edges and having a vertical extent or width which is sufficiently reduced so as to facilitate lateral buckling in response to heat induced compression loads which also cause downward buckling of the flange means 19*a* at each of the apexes 56*a* and 76*a*.

While preferred embodiments of the present invention have been shown and described herein, it is obvious that many structural details may be changed without departing from the spirit and scope of the appended claims. For example, it is contemplated that, in certain instances, the bead interruptions and slot means of the type shown in FIGS. 7–9 could be replaced by providing the runner with slit means and ledge elements substantially identical to slit means and ledge elements 36*a*, 42*a* and 43*a* except that they would be inverted and located adjacent the upper bead 18*a*.

The invention is claimed as follows:

1. A longitudinally extending runner for a fire-rated ceiling suspension system comprising a web, an interrupted bead along one web margin, a flange along the other web margin, a buckleable web expansion member substantially longitudinally coextensive with the bead interruption which is adapted to deform into a diamond-shaped pattern extending away from both sides of the web when compressive forces are applied to the runner in a longitudinal direction, the web being partially divided by a longitudinally oriented slot extending substantially in one direction only from and under said web expansion member for a limited distance, a portion of the web adjacent the slot and between the slot and the flange partially defining two opposed, longitudinally offset L-shaped lipped ledges, together extending beneath the web interruption, the expansion member and the slot for a distance equal to the slot, each ledge terminating adjacent the opposite ledge in a diagonally downturned end ledge portion adjacent a ledge end-defining slit, the ledge end portions together defining a V-shaped configuration longitudinally spaced apart from said expansion member to retain general runner shape when the runner undergoes expansion-induced buckling and having its apex adjacent the runner flange to permit the flange and web ledges to buckle away from the remaining portion of the web in a predetermined configuration when compressive forces are applied to the runner in a longitudinal direction.

2. A runner according to claim 1 wherein said web ledges each include a ledge portion extending substantially parallel to the runner flange, and a lip portion extending substantially parallel to the runner web.

3. A runner according to claim 1 including web stiffener means located on that portion of the web between the slot and the bead, and extending longitudinally along the web.

4. A runner according to claim 3 wherein said web stiffener means includes bead means formed in said web.

5. A runner according to claim 4 wherein said bead means extends longitudinally along the web for a distance substantially coextensive with the length of said slot.

6. A longitudinally extended runner for a firerated ceiling suspension system comprising a web, an interrupted bead along one web margin, a flange along the other web margin, a buckleable web expansion member substantially longitudinally coextensive with the bead interruption, the web expansion member including at least two reaches mutually abutting at their ends but diverging to spaced apart midportions in a relatively elongated diamond-shaped pattern extending away from both sides of the web to permit the web expansion member to buckle and the reaches to bend outwardly away from one another in a foreshortened diamond-shaped configuration extending away from both sides of the web when compressive forces are applied to the runner in a longitudinal direction, the web being partially divided by a longitudinally oriented slot extending substantially in one direction only from and under said web expansion member for a limited distance, a portion of the web adjacent the slot and between the slot and the flange partially defining two opposed, longitudinally offset L-shaped lipped ledges, together extending beneath the web interruption, the expansion member and the slot for a distance equal to the slot, each ledge terminating adjacent the opposite ledge in a diagonally downturned end ledge portion adjacent a ledge end-defining slit, the ledge end portions together defining a V-shaped configuration longitudinally spaced apart from said expansion member to retain general runner shape when the runner undergoes expansion-induced buckling and having its apex adjacent the runner flange to permit the flange and web ledges to buckle away from the remaining portion of the web in a predetermined configuration when compressive forces are applied to the runner in a longitudinal direction.

7. A runner according to claim 6 wherein said reaches are adapted to bend away from one another in a diamond-shaped pattern when compressive forces are applied to the runner in a longitudinal direction, said diamond-shaped pattern having its longitudinal axis coextensive with the longitudinal axis of the runner and each reach deforming away from said longitudinal axis upon opposite sides of said runner web.

8. A runner according to claim 7 wherein said reaches are perforated, and wherein said reach perforations are arrayed in three columns perpendicular to the longitudinal extent of the runner, a first perforation column being located adjacent an end of the expansion member reaches, a second perforation column being located at each reach mid-portion, and the third perforation column being located at the opposite end of the expansion member reaches to encourage said reaches to bend at the perforation columns and encourage said web expansion member to buckle in said foreshortened diamond-shaped configuration.

9. A longitudinally extended runner for a firerated ceiling suspension system comprising a web, an interrupted bead along one web margin, a flange along the other web margin, a buckleable web expansion member substantially longitudinally coextensive with the bead interruption, the web expansion member including at least two perforated reaches mutually abutting at their ends but diverging to spaced apart mid-portions, said reach perforations being arrayed in three columns perpendicular to the longitudinal extent of the runner, a first perforation column being located adjacent an end of the expansion member, a second perforation column being located at the expansion member mid-portion, and a third perforation column being located at the opposite end of the expansion member to permit the web expansion member to buckle and the reaches to bend away from one another in a longitudinally foreshortened diamond-shaped configuration extending from both sides of the web when compressive forces are applied to the runner in a longitudinal direction, the web being partially divided by a longitudinally oriented slot extending substantially in one direction away from and under said web expansion member for a limited distance, a portion of the web adjacent the slot and between the slot and the flange defining two opposed but longitudinally offset L-shaped lipped ledges, together extending beneath the web interruption, the expansion member and the slot for a distance equal to the slot each ledge terminating adjacent the opposite ledge in a diagonally downturned end ledge portion adjacent a ledge end-defining slit, the ledge end portions together defining a V-shaped configuration longitudinally spaced apart from said expansion member and having its apex adjacent the runner flange to permit the flange and web ledges to buckle away from the remaining portion of the web in a predetermined configuration when compressive forces are applied to the runner in a longitudinal direction.

10. A runner according to claim 9 including means for connecting said longitudinally extended runner to transversely oriented cross-tee members in load bearing relationship.

11. A longitudinally extended runner according to claim 9 including means for connecting said runner to adjacent longitudinally coextensive runners.

12. A longitudinally extending runner for a firerated ceiling suspension system comprising a web, a flange along a web margin, the web being partially divided by a longitudinally oriented slot extending for a limited distance, a portion of the web adjacent the slot and between the slot and the flange being deformably offset from the remaining web material to define two opposed, longitudinally offset L-shaped lipped ledges having opposed, upturned ledge portions together extending beneath the slot for a distance equal to the slot, each ledge terminating adjacent the opposite ledge in a diagonally downturned end ledge portion adjacent a ledge end defining slit, the ledge end portions together defining a V-shaped configuration having its apex adjacent the runner flange to permit the flange and web ledges to buckle away from the remaining portion of the web in a predetermined configuration when compressive forces are applied to the runner in a longitudinal direction.

13. A longitudinally extending runner for a firerated suspension system comprising a web having upper and lower longitudinally extending margins, first enlarged stiffener means extending along one of said web margins, second enlarged stiffener means extending along the other of said web margins, at least two opposed, longitudinally offset L-shaped lipped ledges formed of web material and extending longitudinally along the web for a limited distance adjacent one of said stiffener means, formation of the ledges from web material thereby creating a slit in the web partially separating the ledges from remaining portions of the web, each ledge terminating adjacent the opposite ledge in a diagonally, deformed edge portion adjacent a ledge end-defining slit, the ledge end portions together defining a V-shaped configuration having its apex adjacent said one enlarged stiffener means and the associated web margin to permit that stiffener and the web ledges to buckle away from the remaining portion of the web in a predetermined configuration when compressive forces are applied to the runner in a longitudinal direction.

14. A runner according to claim 13 including two ledges extending in opposite directions from one another on opposite sides of said web.

15. A runner according to claim 13 wherein said first enlarged stiffener means includes bead means extending along the upper web margin and said second enlarged stiffener means includes flange means extending along said lower web margin.

16. A runner according to claim 15 which includes interruption means in said bead means and a portion of said web substantially in vertical alignment with said slot means for facilitating collapsing of said bead means and the web in response to compressive forces.

17. A runner according to claim 16 wherein said interruption means has an upper margin defined by oppositely upwardly inclined edges intersecting at an apex substantially in vertical alignment with said first mentioned apex.

18. A runner according to claim 17 wherein said interruption means has a lower edge disposed substantially parallel to said slot means and opposite downwardly from said upper web margin.

* * * * *